US007600322B2

(12) United States Patent
Kao

(10) Patent No.: US 7,600,322 B2
(45) Date of Patent: Oct. 13, 2009

(54) FOLDING KNIFE

(76) Inventor: Chih-Chen Kao, No. 109, Jhonghua Rd., Taoyuan City, Taoyuan County (TW)

( * ) Notice: Subject to any disclaimer, the term of this patent is extended or adjusted under 35 U.S.C. 154(b) by 200 days.

(21) Appl. No.: 11/822,767

(22) Filed: Jul. 10, 2007

(65) Prior Publication Data

US 2008/0295338 A1 Dec. 4, 2008

(30) Foreign Application Priority Data

Jun. 4, 2007 (TW) ..... 96209157 U

(51) Int. Cl.
*B26B 3/06* (2006.01)

(52) U.S. Cl. ..... 30/151; 30/155; 30/160

(58) Field of Classification Search ..... 30/161, 30/155, 158, 159, 160; 81/319, 322, 323, 81/417, 427, 427.5, 486; 7/158, 168, 900
See application file for complete search history.

(56) References Cited

U.S. PATENT DOCUMENTS 553,430 A * 1/1896 Schmachternberg ..... 30/158
730,025 A * 6/1903 Kaufmann ..... 30/161
5,331,741 A * 7/1994 Taylor, Jr. ..... 30/158
5,685,079 A * 11/1997 Brothers et al. ..... 30/161
6,523,265 B2 * 2/2003 Eickhorn ..... 30/161
7,140,110 B2 * 11/2006 Lake ..... 30/160

* cited by examiner

*Primary Examiner*—Boyer D Ashley
*Assistant Examiner*—Omar Flores-Sánchez
(74) *Attorney, Agent, or Firm*—Bacon & Thomas, PLLC

(57) ABSTRACT

A folding knife has a handle and a blade. The blade is pivotally coupled to the handle. The handle includes a latch element, a resilient element and a turning element. An end of the resilient element is fixed into the handle. The latch element is pivotally coupled into the handle. An end of the latch element is extended to an end of the blade. Another end of the latch element presses against another end of the resilient element. The resilient element pushes the latch element to turn the blade out from the handle or store the blade completely into the handle. The turning element is pivotally coupled into the handle, such that when a force is exerted to push the latch element towards the resilient element to release the blade, the blade can be movably turned out from the handle or stored into the handle.

10 Claims, 6 Drawing Sheets

FOLDING KNIFE

FIELD OF THE INVENTION

The present invention relates to a folding knife, and more particularly to a folding knife that enhances the safety and convenience of the knife.

BACKGROUND OF THE INVENTION

Various kinds of folding knifes are available in the market. Referring to FIGS. 1 and 2 for one of the traditional folding knifes, the folding knife 1 is consisted of a handle 100 and a blade 110, wherein an end of the blade 110 is pivotally coupled into an end of the handle 100 by a first pivot 120, and the handle 100 further includes a latch element 130 and a resilient element 140 therein. The latch element 130 is pivotally coupled into the handle 100 by a second pivot 131, and an end of the latch element 130 is pressed onto an end of the blade 110, and another end of the latch element 130 is extended towards another end of the handle 100, and another end of the latch element 130 has a pressing portion 150 which can be turned out from the handle 100. An end of the resilient element 140 is fixed into the handle 100 and disposed at a position away from the first pivot 120, and another end of the resilient element 140 is pressed onto another end of the latch element 130, such that the resilient element 140 can push the latch element 130 to latch and fix the blade 110 at a status of being extended out of the handle 100 or latch and fix the blade 110 at a status of being stored into the handle 100. If a user controls the blade 110 such that the blade 110 can be movably extended out of or stored into the handle 100, the latch element 130 will be pushed towards the resilient element 140 by the pressing portion 150 to release the blade 110 from the latch of the latch element 130.

To prevent the pressing portion 150 from being collided or compressed accidentally or the user from releasing the latch of the latch element 130 with the blade 110 by mistake and thus the blade 110 may have the risk of being turned out, it is necessary to design the folding knife 1 in such a way that when a user wants to turn the blade 110 out of the handle 100, the user needs to hold the handle 100 by one hand and presses the pressing portion 150 to release the latch of the latch element 130 with the blade 110, while the blade 110 is being pulled by another hand in order to turn the blade 110 out from the handle 100. In other words, when the user presses the pressing portion 150 to release the latch of the latch element 130 with the blade 110, the user has to turn the blade 110 out from the handle 100 by both hands.

However, such good intention causes another risk, since the folding knife 1 cannot be used immediately by one hand during a special or emergency situation. For instance, if a diver's hand is tangled by a fish net while the diver is diving, the diver will not be able to use the folding knife 1 to cut the fish net immediately by the other hand, and thus causing a fatal threat to the diver.

Further, when the user returns the blade 110 from the outside of the handle 100 into the handle 100, the user needs to hold the handle 100 by a palm and press the pressing portion 150 to release the latch of the latch element 130 with the blade 110 while pushing the blade 110 by another hand in order to turn the blade 110 into the handle 100. However, the user's palm is still holding the handle 110 at the moment when the blade 110 is being turned into the handle 100. When the user turns the blade 110 towards the handle 100 at a position on the moving route into the handle, the user may cut his or her palm that is still holding handle 100 accidentally and thus causing a serious injury to the user.

In summation, finding a way of designing a novel folding knife to overcome the shortcomings of the traditional folding knifes and enhancing the safety and convenience of the knife becomes an important subject for manufacturers.

SUMMARY OF THE INVENTION

In view of the foregoing shortcomings of the prior art, the inventor of the present invention based on years of experience in the related industry to conduct extensive researches and experiments, and finally developed a folding knife in accordance with the present invention to overcome the shortcomings of the prior art.

It is a primary objective of the present invention to provide a folding knife, comprising: a handle and a blade, wherein an end of the blade is pivotally coupled into an end of the handle by a first pivot, and the handle includes a latch element, a resilient element and a turning element therein, and an end of the resilient element is fixed into the handle, and the latch element is pivotally coupled into the handle by a second pivot, and an end of the latch element is extended to an end of the blade, and another end of the latch element is extended to a position that presses against another end of the resilient element. The latch element can be pushed by the resilient element, such that when the blade is turned out from the handle, an end of the latch element is latched with an end of the blade, or when the blade is stored completely into the handle, an end of the latch element presses against an end of the blade to position the blade in a status of being stored into the handle. Further, the turning element is pivotally coupled into the handle by a third pivot, and an end of the turning element presses against another end of the latch element, such that when a force is exerted onto another end of the turning element to push another end of the latch element in a direction towards the resilient element, an end of the latch element is separated from an end of the blade to release the blade and movably turn the blade out from the handle, or movably store the blade into the handle. Therefore, a user can control whether or not to movably turn the blade out of the handle or store the blade into the handle by turning the turning element with one hand, so as to effectively overcome the shortcomings of the prior art folding knifes and solve the problem of unable to movably turn out the blade from the handle or movably store the blade into the handle by one hand only.

Another objective of the present invention is to turn the turning element to release the latch of the latch element with the blade in order to store the blade into the handle. When a user wants to return the blade outside the handle into the handle, the user needs not to place the palm at the position of the moving route for turning the blade into the handle, and such arrangement can prevent users from accidentally cutting their palm that holds the handle when the blade is turned towards the handle and effectively enhance the safety of the folding knife and prevent injuries to users.

To make it easier for our examiner to understand the objective, technical characteristics and effects of the present invention, preferred embodiments will be described with accompanying drawings as follows:

DETAILED DESCRIPTION OF THE PREFERRED EMBODIMENTS

Figure 1:
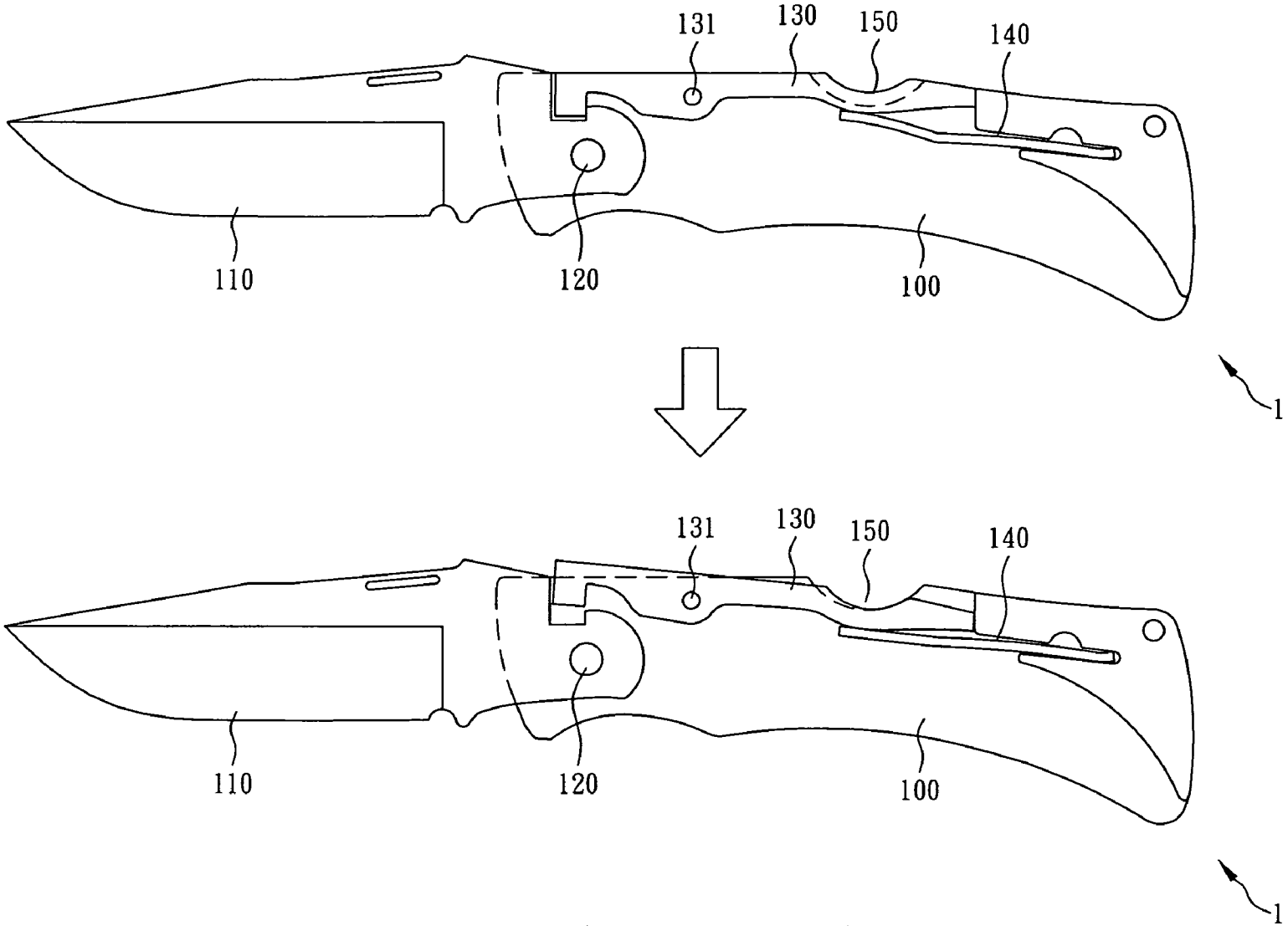
FIG. 1 (Prior Art)
FIG. 1 is a schematic view of a status of using a conventional folding knife.
Figure 2:
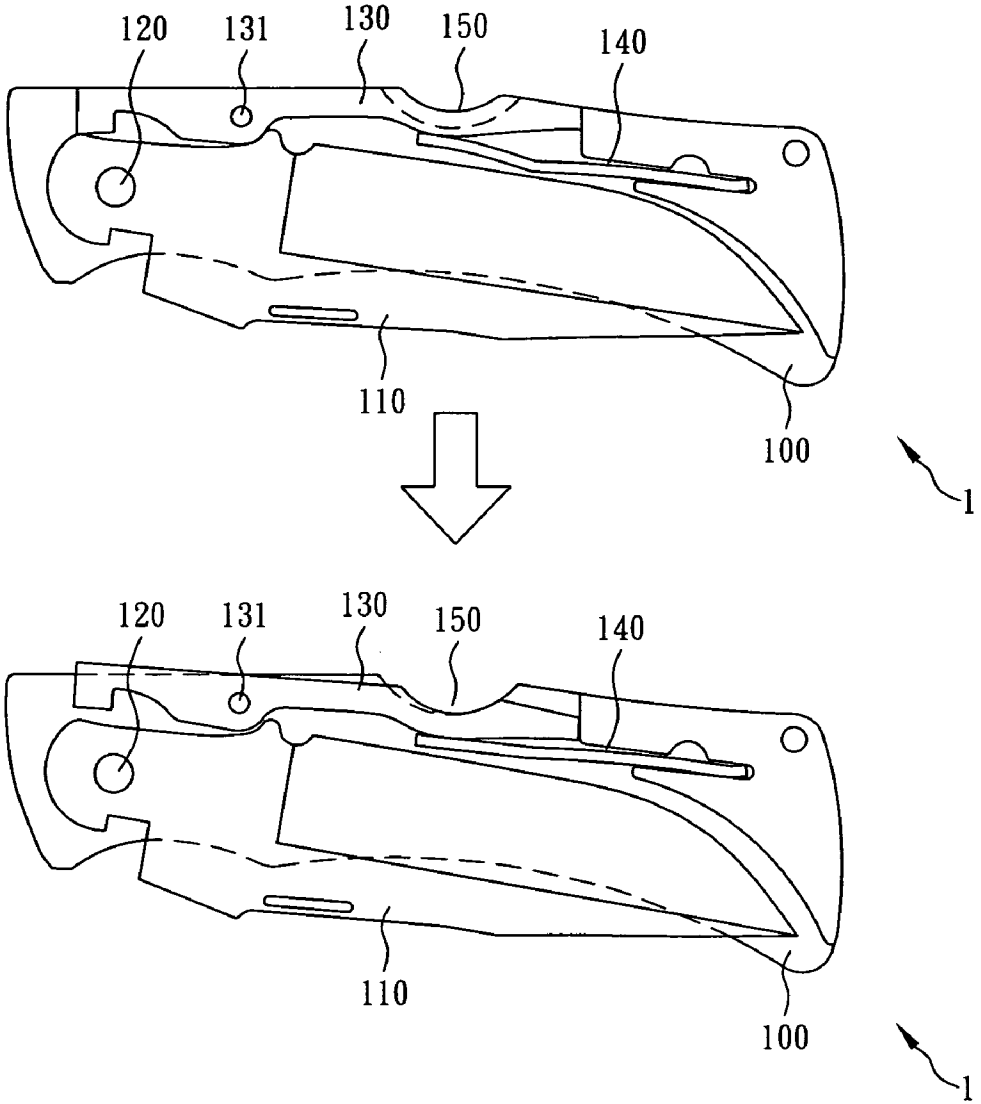
FIG. 2 (Prior Art)
FIG. 2 is another schematic view of another status of using a conventional folding knife.

Referring to FIGS. 3 to 6 for a preferred embodiment of the present invention, the folding knife 2 comprises a handle 20 and a blade 210, wherein the handle 20 includes a first plate 200, a second plate 201, a third plate 202 and a fourth plate 203, and the plates 200, 201, 202, 203 are stacked together sequentially, and an end of the plates 200, 201, 202, 203 is passed through by a first pivot 204, and an end of the blade 210 that is away from an end of the knife tip 211 is pivotally coupled between the second plate 201 and the third plate 202 by the first pivot 204, and a back of the knife 212 of the blade 210 has a first latch portion 213 disposed at a position proximate to the first pivot 204, and an end of the blade 210 has a second latch portion 214 disposed at a position corresponding to the first latch portion 213.

The folding knife 2 further comprises a latch element 220, a resilient element 230 and a turning element 240, and the latch element 220 is pivotally coupled to the third plate 202 by a second pivot 205, and an end of the latch element 220 is extended to a position corresponding to the first latch portion 213, and another end of the latch element 220 is extended towards another end of the third plate 202, and another end of the latch element 220 has a first connecting portion 250 for pressing against and connecting the turning element 240, and the first connecting portion 250 is substantially in a cylindrical shape, and the resilient element 230 is substantially in a bar shape having an end fixed at the third plate 202 and disposed at a position away from the first pivot 204 and another end pressing against another end of the latch element 220. The resilient element 230 can push the latch element 220, such that when the blade 210 is turned completely out from the handle 20, an end of the latch element 220 is latched with the first latch portion 213 to set the blade 210 in a status of turning the blade 210 out from the handle 20. The resilient element 230 can also push the latch element 220, such that when the blade 210 is stored completely into the handle 20, an end of the latch element 220 presses against the second latch portion 214 to position the blade 210 at a status of storing the blade 210 into the handle 20.

The turning element 240 is pivotally coupled to the second plate 201 by a third pivot 206, and an end of the turning element 240 has a second connecting portion 260 disposed at a position corresponding to the first connecting portion 250 for pressing and connecting the first connecting portion 250. The second connecting portion 260 is substantially in the shape of a hole, and the second plate 201 has a through hole 261 disposed at a position corresponding to the first connecting portion 250 and the second connecting portion 260. Another end of the latch element 220 is passed into the through hole 261 through the first connecting portion 250, and the second connecting portion 260 is pressed against and connected with the turning element 240, such that when a force is exerted onto another end of the turning element 240, one of its ends pushes another end of the latch element 220 to move towards the resilient element 230 and separate an end of the latch element 220 from being latched with the first latch portion 213 or separates an end of the latch element 220 from pressing the second latch portion 220 in order to release the blade 210, and thus the blade 210 can be movably turned out from the handle 20 or movably stored into the handle 20. Users can use one hand to turn the turning element 240 to control whether or not to turn the blade 210 out from the handle 20 or store the blade 210 into the handle 20, so as to greatly enhance the convenience of the folding knife 2.

Referring to FIGS. 3 to 6 again for the foregoing preferred embodiment, the shape of the first connecting portion 250 for pressing and connecting another end of the latch element 220 with the turning element 240 and the shape of the second connecting portion 260 for pressing and connecting an end of the turning element 240 with the latch element 220 can be changed according to the actual design of the folding knife 2 (such as the first connecting portion 250 is substantially in the shape of a hole, and the second connecting portion 260 is substantially in a cylindrical shape). Any shape can be adopted, as long as the shapes match with each other, and the latch element 220 and the turning element 240 can be pressed and connected by the connecting portions 250, 260 for the corresponding movements. Further, the shape and installation position of the resilient element 230 can be changed according to the actual design of the folding knife 2, and they are not limited to a bar shape or fixed onto the third plate 202 and disposed at a position away from the first pivot 204 only. Any shape and installation position of the resilient element 230 can be adopted, as long as an end of the latch element 220 can be latched with the first latch portion 213 when the blade 210 is turned completely out from the handle 20, or an end of the latch element 220 can be pressed against the second latch portion 214 when the blade 210 is stored into the handle 20.

Figure 3:
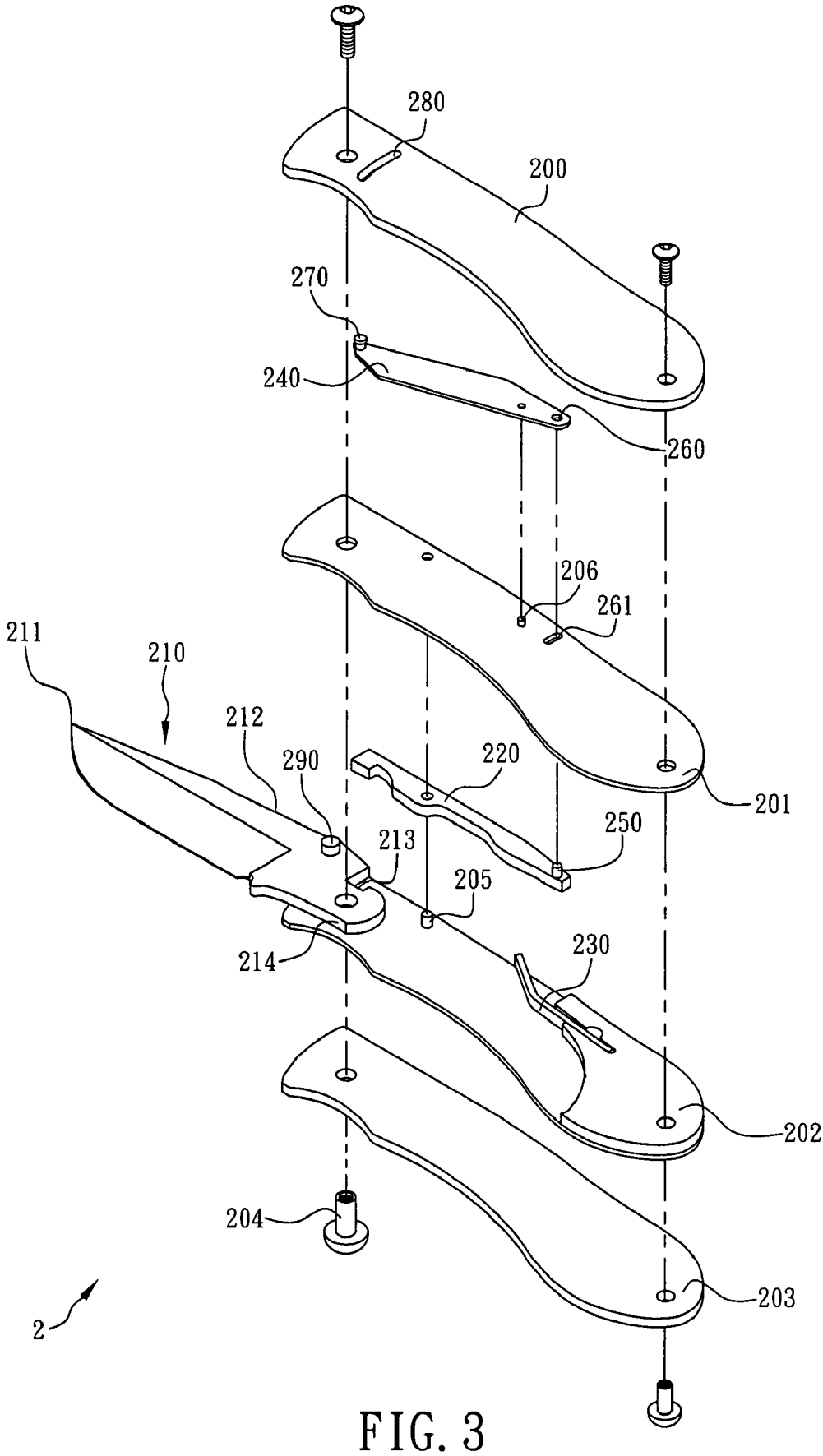
FIG. 3 is an exploded view of a folding knife in accordance with a preferred embodiment of the present invention.
Figure 4:
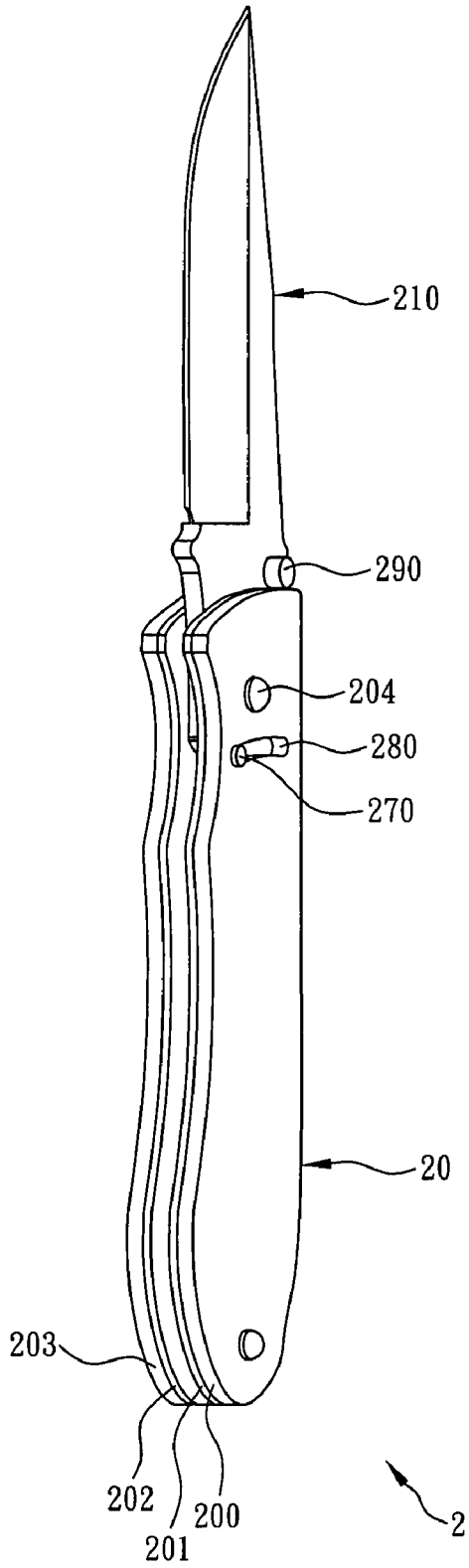
FIG. 4 is a perspective view of a folding knife in accordance with a preferred embodiment of the present invention.
Figure 5:
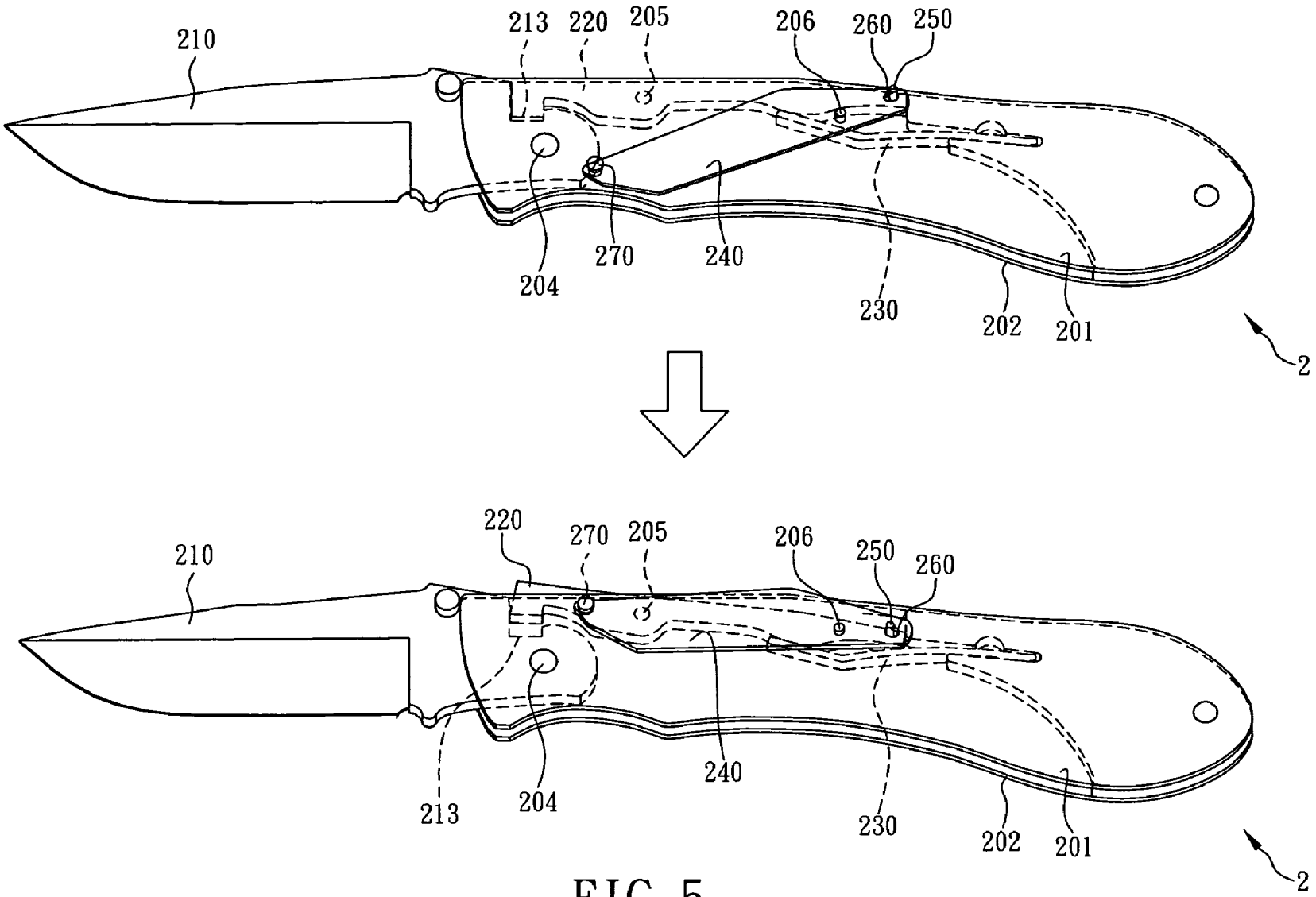
FIG. 5 is a schematic view of a status of using a folding knife in accordance with a preferred embodiment of the present invention.
Figure 6:
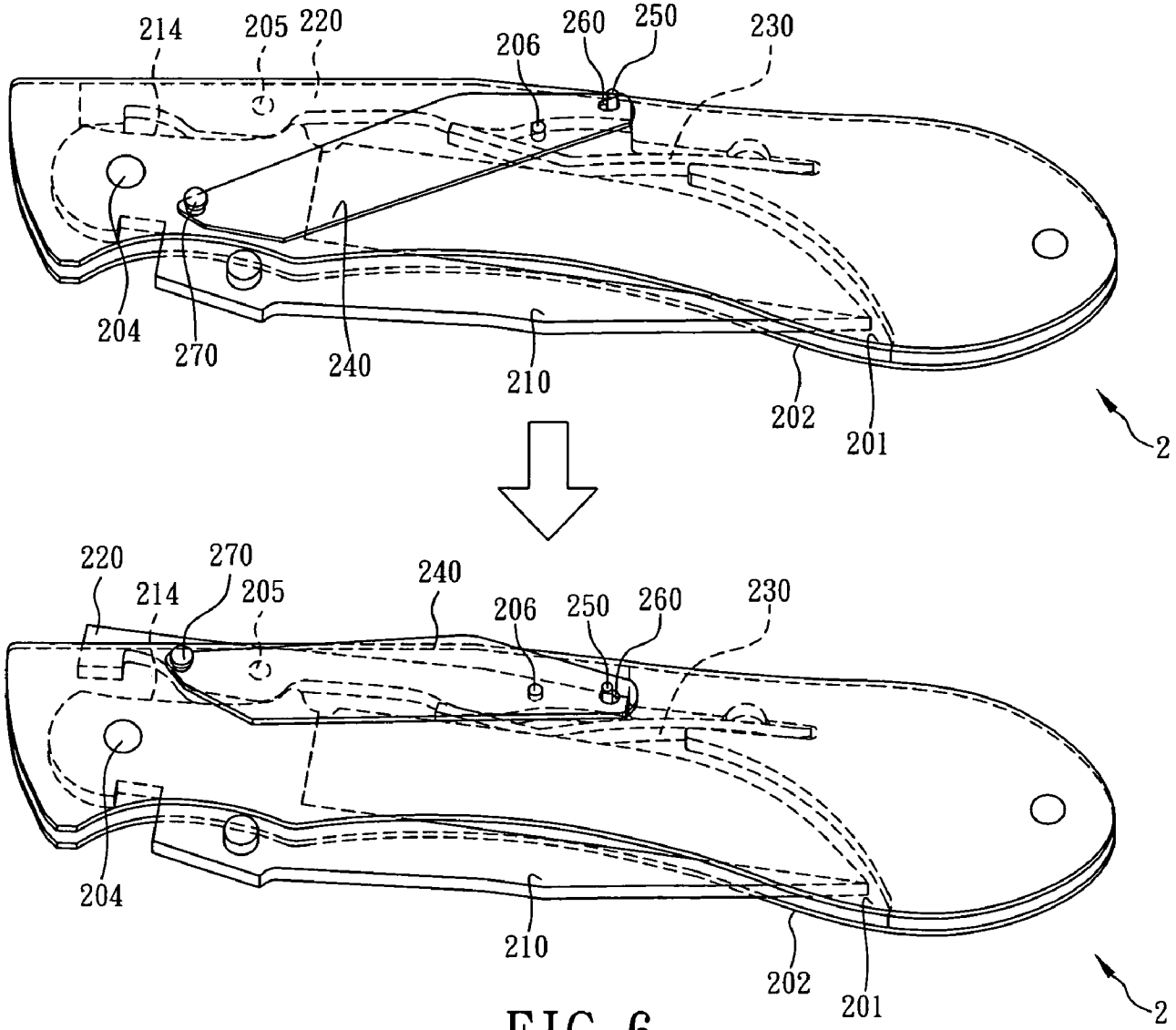
FIG. 6 is a schematic view of another status of using a folding knife in accordance with a preferred embodiment of the present invention

In the preferred embodiment as shown in FIGS. 3 and 4, the first plate 200 has a position limiting hole 280 disposed proximate to the first pivot 204, and the turning element 240 has a protruding rim portion 270 disposed at a position corresponding to the position limiting hole 280. The protruding rim portion 270 is protruded from the first plate 200 and out of the position limiting hole 280. When a user wants to return the blade 210 latched outside the handle 20 into the handle 20, the user needs not to place his or her palm at a position of the moving route for turning the blade 210 into the handle 20, but the user can simply use one hand to turn the protruding rim portion 270 to drive the turning element 240 to release the latch of the latch element 220 with the blade 210 by means of the protruding rim portion 270 at the position limiting hole 280 in order to store the blade 210 into the handle 20. Such arrangement can prevent the user from accidentally cutting his or her palm that still holds the handle 20 when the blade 210 is turned into the handle 20 and effectively enhance the safety of the folding knife 2 or avoid injuries to users. Further, the protruding rim portion 270 can be moved within a range of the opening of the position limiting hole 280 only, and thus preventing the turning element 240 and the protruding rim portion 270 from being moved too much or ruining the adjusting function.

In the preferred embodiment as shown in FIGS. 3 to 6, an end of the latch element 220 is latched with the first latch portion 213 when the blade 210 is protruded out of the handle 20, so that the blade 210 is latched out of the handle 20, and a user can use the folding knife 2 stably for cutting. When the blade 210 is stored into the handle 20, an end of the latch element 220 is pressed onto the second latch portion 214, so that the blade 210 is positioned at a status of being stored in the handle 20, so as to prevent the blade 210 from being protruded out of the handle by the user accidentally, and enhance the safety of the folding knife 2 effectively.

In the preferred embodiment as shown in FIGS. 3 and 4, the blade 210 has a pushing portion 290 disposed at the back of the knife 212, such that when the blade 210 is stored into the handle 20, the pushing portion 290 is protruded from the handle 20. If a user wants to turn the blade 210 out of the handle 20, the user can use a hand to hold the folding knife 2 through the pushing portion 290, while turning the blade 210 out of the handle 20, so as to greatly enhance the convenience of the folding knife 2.

It is noteworthy to point out that the handle 20 of the foregoing preferred embodiment as shown in FIGS. 3 and 4 is not only comprised of the plates 200, 201, 202, 203 only, but it also can be changed according to the actual design of the folding knife 2. Any design can be adopted, as long as the first pivot 204 can be pivotally coupled with the blade 210.

While the invention has been described by means of specific embodiments, numerous modifications and variations could be made thereto by those skilled in the art without departing from the scope and spirit of the invention set forth in the claims.

What is claimed is:

1. A folding knife, comprising:

a handle having a first pivot passing through a first end of the handle;

a blade pivotally coupled to the handle by the first pivot at a first end of the blade away from a knife tip, the blade having a first latch portion disposed at a back of the blade at a position proximate to the first pivot;

a latch element pivotally coupled to the handle by a second pivot, the latch element having a first end extending to a position corresponding to the first latch portion and a second end extending towards a second end of the handle;

a resilient element having a first end fixed in the handle and a second end pressing against the second end of the latch element such that when the blade is extended completely out from the handle the first end of the latch element latches the first latch portion; and a turning element pivotally coupled to the handle by a third pivot, the turning element having a first end which presses the second end of the latch element such that when the blade is extended completely out from the handle and a force is exerted on a second end of the turning element to push the second end of the latch element, the first end of the latch element is separated from the first latch portion to release the blade, and the blade can be movably stored into the handle.

2. The folding knife as recited in claim 1, wherein the blade has a second latch portion disposed at the first end of the blade at a position adjacent to the first latch portion, such that when the blade is completely stored into the handle the first end of the latch element presses onto the second latch portion to position and fix the blade into the handle.

3. The folding knife as recited in claim 1, wherein the latch element has a first connecting portion disposed at the second end of the latch element.

4. The folding knife as recited in claim 3, wherein the turning element has a second connecting portion disposed at the first end of the turning element at a location corresponding to the first connecting portion.

5. The folding knife as recited in claim 1, wherein the handle has a position limiting hole disposed at a position proximate to the first pivot.

6. The folding knife as recited in claim 5, wherein the turning element has a protruding rim portion disposed at a position corresponding to the position limiting hole, and the protruding rim portion extends out of the handle from the position limiting hole.

7. The folding knife as recited in claim 1, wherein the blade has a pushing portion disposed at a position proximate to a back of the blade and extending from the handle.

8. The folding knife as recited in claim 1, wherein the handle is formed by a plurality of plates including at least one outer plate, the at least one outer plate having a position limiting hole extending transversely to a longitudinal direction of the handle, wherein the second end of the turning element has a protruding rim portion for receiving the force exerted on the second end of the turning element.

9. The folding knife as recited in claim 8, wherein the protruding rim extends through the position limiting hole.

10. The folding knife as recited in claim 9, wherein the protruding rim is slidably contained within the position limiting hole.

* * * * *